US007802749B2

(12) United States Patent
Chadwick

(10) Patent No.: US 7,802,749 B2
(45) **Date of Patent: *Sep. 28, 2010**

(54) CREEL MAGAZINE SUPPLY SYSTEM AND METHOD

(75) Inventor: David Chadwick, Alpharetta, GA (US)

(73) Assignee: Automated Creel Systems, Inc., Alpharetta, GA (US)

( * ) Notice: Subject to any disclaimer, the term of this patent is extended or adjusted under 35 U.S.C. 154(b) by 13 days.

This patent is subject to a terminal disclaimer.

(21) Appl. No.: 11/875,254

(22) Filed: Oct. 19, 2007

(65) Prior Publication Data

US 2009/0101742 A1 Apr. 23, 2009

Related U.S. Application Data

(60) Provisional application No. 60/885,743, filed on Jan. 19, 2007.

(51) Int. Cl.
*B65H 67/00* (2006.01)
*B65H 49/00* (2006.01)
*D02H 1/00* (2006.01)

(52) U.S. Cl. ..... 242/560; 242/131; 28/193; 66/125 R

(58) Field of Classification Search ..... 242/551, 242/557, 558, 559, 559.3, 560, 588, 590, 242/593, 594, 594.6, 597, 597.8, 131, 131.1; 139/246–252; 414/222.01, 267, 331; 66/125 R, 66/125 A, 168; 28/190, 193
See application file for complete search history.

(56) References Cited

U.S. PATENT DOCUMENTS 3,321,153 A * 5/1967 Bryan, Jr. ..... 242/131
3,377,677 A * 4/1968 Furst ..... 28/193
4,498,644 A * 2/1985 Kupper et al. ..... 242/131.1
4,852,824 A * 8/1989 Beitz et al. ..... 242/131.1
5,142,159 A 8/1992 Veit et al.
5,165,615 A 11/1992 Polnik
5,170,953 A 12/1992 Stahlecker
5,180,269 A 1/1993 Nishioka
5,211,000 A 5/1993 Fink et al.
5,222,676 A 6/1993 Rebsamen
5,236,142 A 8/1993 Teranishi et al.
5,245,818 A 9/1993 Scheufeld et al.
5,301,886 A 4/1994 Kathke et al.
5,315,366 A 5/1994 Inada et al.
5,356,085 A 10/1994 Kobayashi et al.
5,360,098 A 11/1994 Nishikawa
5,387,263 A 2/1995 Marlowe et al.
5,399,815 A 3/1995 Ballarati (Continued)

OTHER PUBLICATIONS

Engineered Crane Systems of America Catalog.

*Primary Examiner*—John Q Nguyen
*Assistant Examiner*—William E Dondero
(74) *Attorney, Agent, or Firm*—Smith, Gambrell & Russell

(57) ABSTRACT

A creel magazine for delivering packaged stranded material to a creel. The magazine includes magazine frame having guides for directing stranded materials to a creel or manufacturing process. Movable magazine cartridges rotatably support packages of stranded materials and are positioned on either side of the magazine frame. The apparatus and method provide for sequential delivery of stranded materials by alternating delivery sources between cartridges, intermediate replenishment of spent packages by rotation of a full package to a delivery position, and replenishment of spent cartridges.

27 Claims, 10 Drawing Sheets

U.S. PATENT DOCUMENTS 5,451,006 A * 9/1995 Smith ..... 242/131.1
5,495,990 A 3/1996 Tamura et al.
5,522,565 A 6/1996 Deshaies
5,639,036 A 6/1997 Flamm
5,653,326 A 8/1997 Liedgens
5,653,395 A 8/1997 Iwade et al.
5,660,343 A 8/1997 Schippers et al.
5,681,000 A 10/1997 Göbbels et al.
5,683,056 A 11/1997 Gravitt
5,725,164 A 3/1998 Binner
5,727,744 A 3/1998 Threlkeld et al.
5,738,290 A 4/1998 Straaten et al.
5,740,981 A 4/1998 Haak
5,803,134 A 9/1998 Smith
5,806,775 A 9/1998 Smith et al.
5,826,815 A 10/1998 Hermanns et al.
5,957,403 A 9/1999 Pöppinghaus
6,027,060 A 2/2000 Siepmann
6,032,890 A 3/2000 DesRosiers
6,045,084 A 4/2000 Binner et al.
6,053,450 A 4/2000 Naito et al.
6,065,712 A 5/2000 Mayer et al.
6,186,435 B1 2/2001 Mayer et al.
6,206,323 B1 3/2001 Byars
6,231,620 B1 5/2001 Tsui
6,280,841 B1 8/2001 Miyazawa et al.
6,315,236 B1 11/2001 Oberstrass et al.
6,457,668 B1 10/2002 Jaschke et al.
6,709,689 B2 3/2004 Koyanagi et al.
6,725,639 B2 4/2004 Ishii et al.
6,729,574 B2 5/2004 Henry et al.
6,856,050 B2 2/2005 Flechon
6,938,849 B2 9/2005 Badiali
7,163,174 B2 1/2007 Lieber
7,163,742 B2 1/2007 Koyanagi et al.
7,165,735 B2 1/2007 Gilbos et al.

* cited by examiner

CREEL MAGAZINE SUPPLY SYSTEM AND METHOD

This application claims priority from U.S. Provisional Patent Application No. 60/885,743 filed Jan. 19, 2007 incorporated herein by reference.

BACKGROUND OF THE INVENTION

1. Technical Filed

The present invention generally relates to creels used for supplying stranded materials to a machine or process for subsequent treatment of the stranded materials or for the fabrication of articles out of the stranded materials. More particularly, the present invention relates to an apparatus and method for supporting a plurality of spools of stranded material, or packages, such that the stranded material carried by the packages may be sequentially supplied to a machine or industrial process. With even greater particularity, the invention relates to a creel magazine capable of receiving and guiding a predetermined number of strands of material to a machine or industrial process, wherein a creel cartridge carries a plurality of material packages sequentially connected for each of the predetermined strands.

2. Related Art

The use of creels for supporting stranded material packages is well known in the textile industry and finds application in other industries utilizing stranded materials as well. Modern high-speed processing systems require a continuous, uninterrupted supply of yarns, fed from a plurality of yarn packages supported throughout the creel. However, despite their widespread use, the task of loading and maintaining the supply of stranded materials in the creel remains an extremely labor intensive operation, involving both gross and fine motor skills. Moreover, the efficiency of these systems is dependent upon the ability to provide a continuous stream of material to the process. Interruptions of the process are usually caused by a breakage of the stranded material which occur most frequently where successive material packages are joined, such as by a knot or other methods well known in the art.

Depending on the location of the breakage, process down time can be a matter of minutes, reflecting system shutdown, fault diagnosis, rejoining the broken strands, and system restart procedures. Moreover, modern high speed processing systems are usually designed with fault detection measures that are intended to prevent broken strands from entering the processing machinery. However, should these systems fail and a strand breakage enters the system, or where a strand breaks internally of the system, delays on the order of hours may be experienced as the entire machine will need to be reset.

Conventional creel systems utilize yarn package supports which are arrayed on a plurality of support posts extending from a free standing frame of the creel and positioned so as to feed the manufacturing process. Eyelets or other guide means are provided vertically and laterally throughout the creel through which each of a plurality of yarn strands are fed to the processing system. Accordingly, monitoring, loading and maintenance of the creel is performed from a front side of the creel so that the operators will not be exposed to hazards presented by running lengths of stranded materials extending from the back side of the creel. In the typical process, a pair of package supports are configured in alignment with each eyelet and the respective yarn strands from the paired packages are tied or otherwise attached in series to alternately feed the process.

Replacement of a yarn package in a creel typically requires a worker to remove a rotate a depleted package cone out of the creel from its working position to a loading position; remove and dispose of a spent cone from the package holder; lift the replacement yarn package from a delivery platform, such as a pallet or bulk container cart; transport the package to the indicated package support; manipulate the package to mount it on the package support; rotate the replenished package support into the creel; and tie or otherwise secure the lead end of the replenished yarn package to the tail end of the paired feeding yarn package. As can be readily seen, the operation and maintenance of a typical creel is and remains a labor intensive task In systems utilizing manual loading methods, a typical package will be limited to having a weight on the order of 8 to 14 pounds. In a given shift, a textile worker tasked with loading and maintaining the creel in a conventional process will lift, transport, and manipulate as much as six thousand pounds of packaged materials. Because the package supports are arrayed at varying heights and distances from the delivery platform, the typical laborer is subjected to significant risk of musculo-skeletal injuries presented at each step of the yarn package replacement process. Moreover, because the loading and replenishment of individual packages occurs at the creel, the activity remains a complex labor intensive one when combined with the related tasks of monitoring the condition, maintenance and performance of the system. Accordingly, there remains a need for improving the efficiency and reducing the complexity of creel operations.

BRIEF SUMMARY OF THE INVENTION

Objects of the present invention are to improve the efficiency of creel systems utilized in manufacturing processes utilizing packages of stranded materials. This object is realized by providing the process with a pre configured supply of materials ready for direct loading into the creel. The preconfigured supply of materials, carried on movable carts, or cartridges, are preferably loaded by automated means at a separate work station. More preferably, the packages are loaded directly onto the cartridge following completion of a preceding process. Other aspects of the invention provide means for reducing the complexity of operator tasks performed at the creel, thereby relieving the risk of musculo-skeletal stresses on the laborers tasked to operate a creel and improving efficiency and performance of the operator manning that station.

The invention also alleviates risks to operators associated with high speed running strands of material as they are supplied to the process, such as the risk of severing appendages. This hazard is reduced significantly by elevating the running strands overhead of the operator's work station.

BRIEF DESCRIPTION OF THE SEVERAL DRAWINGS

DETAILED DESCRIPTION OF THE INVENTION

Figure 1:
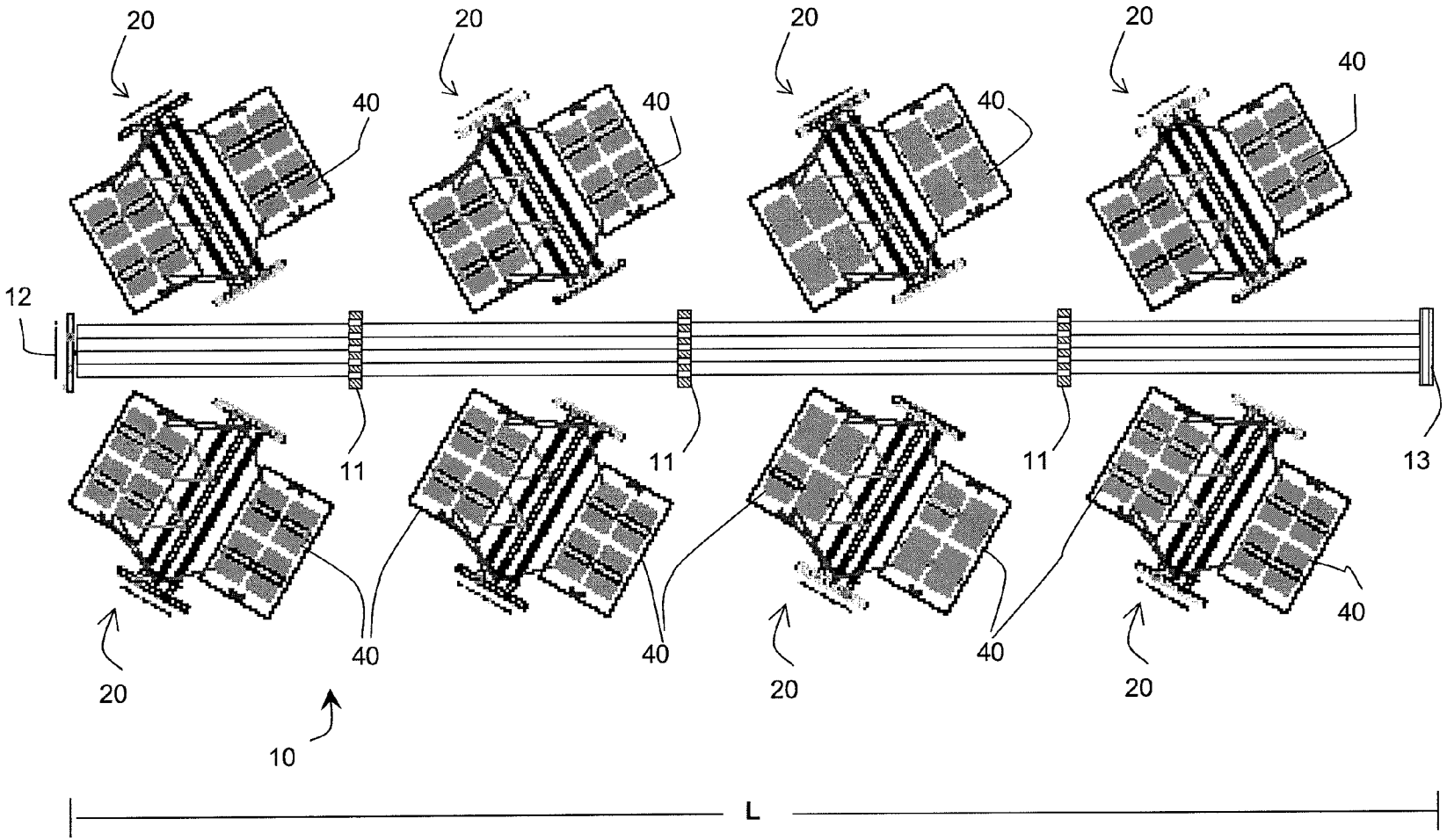
FIG. 1 depicts an overhead plan view of a stranded material magazine supply system for a manufacturing process.
Figure 2:
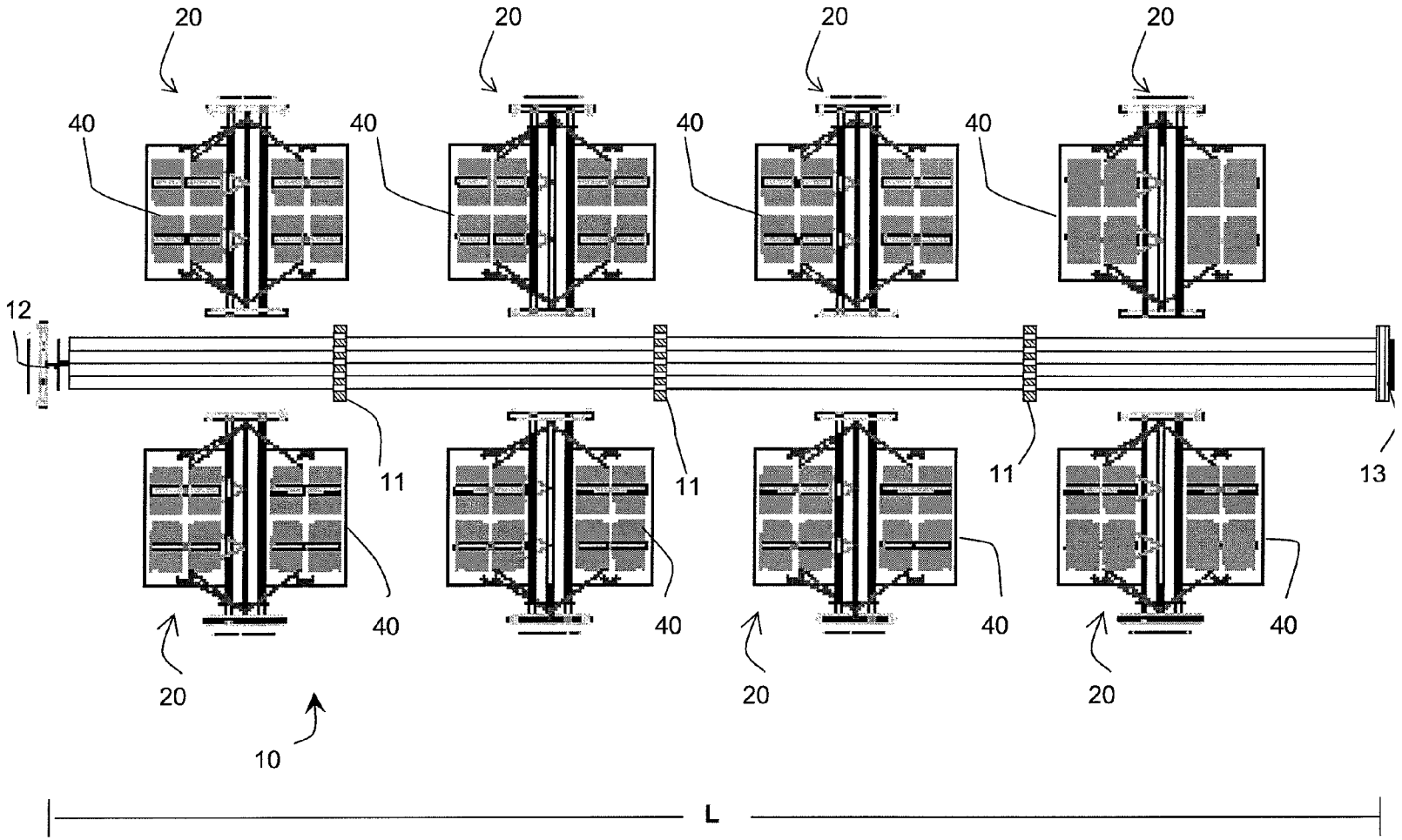
FIG. 2 depicts an alternative overhead plan view of a stranded material magazine supply system for a manufacturing process.
Figure 3:
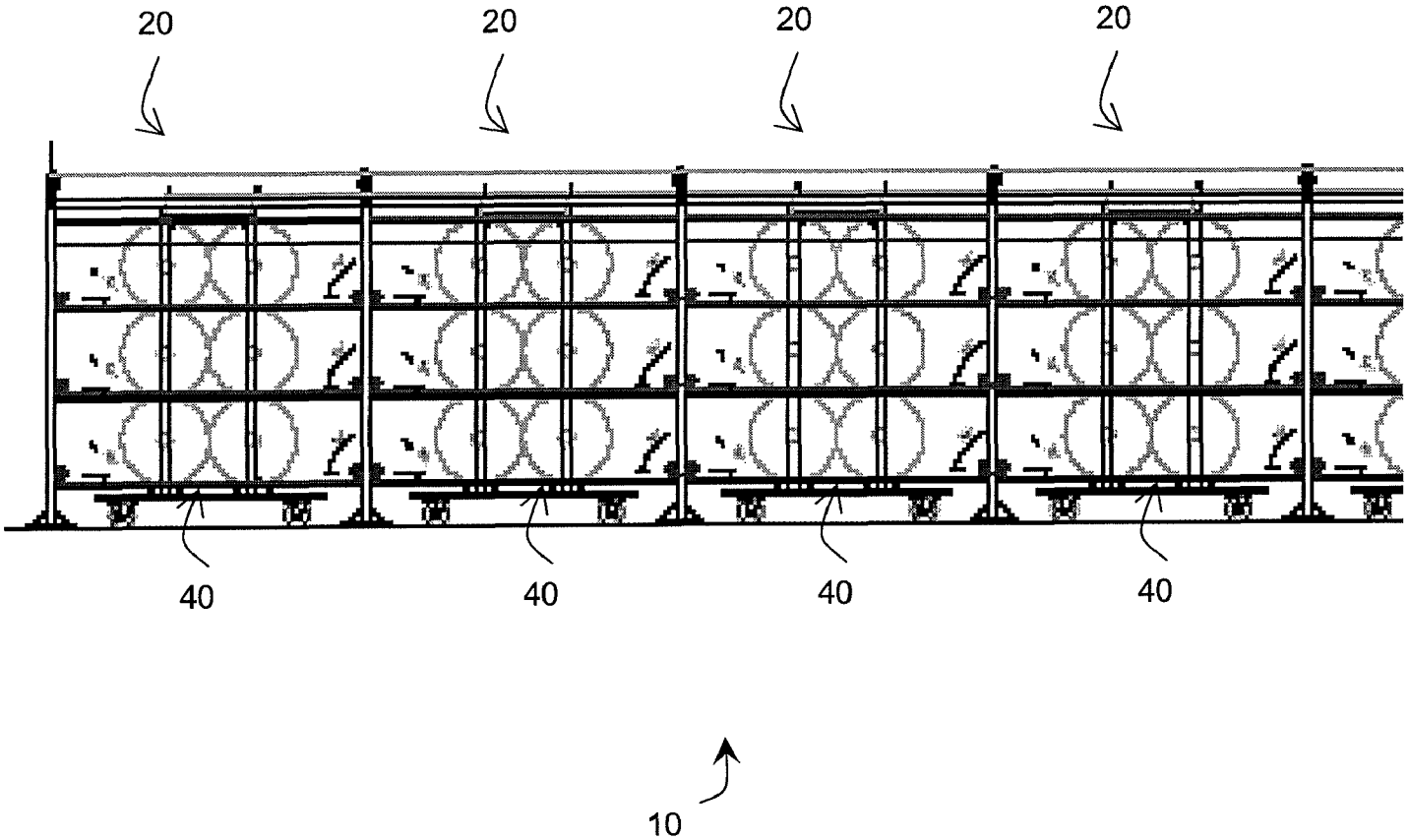
FIG. 3 depicts a side elevational view of a stranded material magazine supply system for a manufacturing process.
Figure 4B:
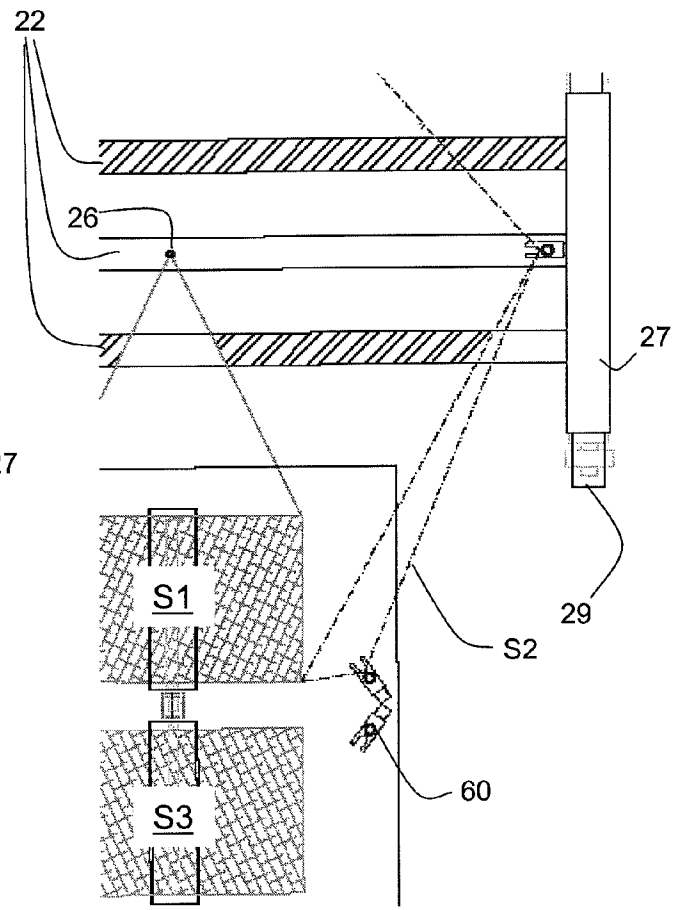
FIG. 4B depicts a detailed view of material routing in the magazine shown in 4A.
Figure 4A:
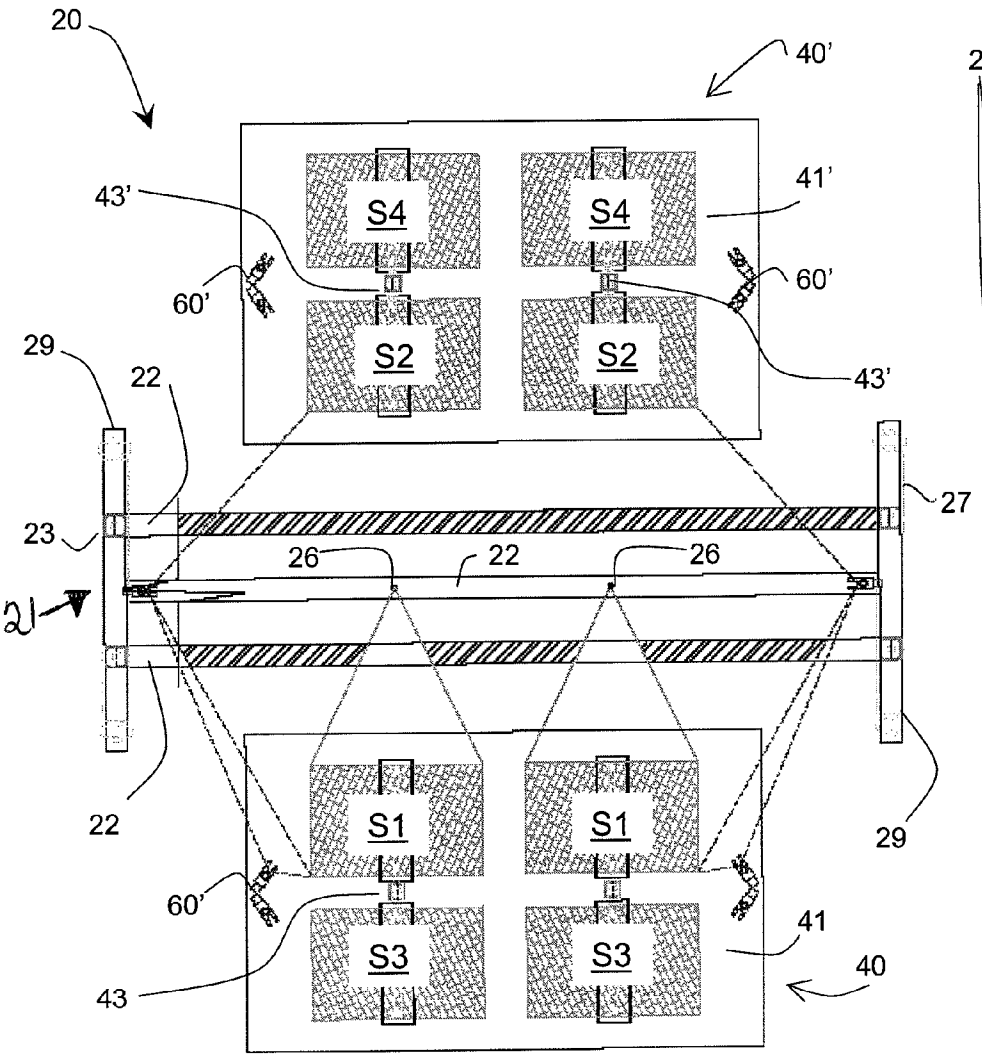
FIG. 4A depicts an overhead plan view of a magazine.

The creel magazine supply system and method of the present invention may be constructed as a complete system or is adaptable to an existing manufacturing facility working stranded materials. In reference to FIGS. 1-4, the system comprises a creel 10, a plurality of creel magazines 20 each containing a plurality of spools of stranded material, or packages 30. After leaving the creel magazines 20, the running ends of the stranded material S are routed to the manufacturing process via creel 10 comprising a plurality of guides 11, guide boards 12, or return rollers 13, supported in the facility according to conventional methods. As will be appreciated by those of skill in the art the length of the creel run L, is generally determined by the machine or process treating the stranded material, particularly with respect to parameters for detecting and preventing material breaks from entering the machine proper, such as the machine operating speed, break detection time, and machine interrupt or shut down times.

The creel magazine supply system and method is designed around magazine 20 comprising a pair of movable replenishable carts, or cartridges 40 and a stationary magazine frame 21. Each cartridge 40 is configured to carry a plurality of packages 30. In the embodiment described, cartridge 40 allows for six running ends of material S to be fed to creel 10 at a time. As may be seen in reference to FIGS. 5 and 6, each cartridge 40 is configured to carry packages 30 in an array of two vertical columns and three rows at a depth of two packages 30 each, for a total of twelve packages 30 per cartridge 40, and total of twenty four packages 30 in a magazine 20 utilizing two cartridges 40.

As may be appreciated, magazines 20 can be arranged to supply creel 10 with any number of running ends of material S. Utilizing the maximum capacity of each magazine 20 configured as described above, incremental strand counts of 48, 42, 36, 30, 24 may be readily achieved according to the needs of the manufacturing process by the addition or subtraction of magazines 30 to the site layout. Magazines 20 may be arranged any number of ways determined by the physical dimensions and process requirements of the manufacturing facility. In a preferred configuration, such as that depicted in FIG. 1, magazines 20 will be angled with respect to the creel run L towards return roller 13 to help reduce friction on the material S and drag on the machine as it pulls the material into the process. An angled design also allows for better access to the magazine 20 and cartridges 40 or carts for tying and routing strands and other maintenance tasks. Maintenance in this area is typically referred to as a "break out" and must be attended to by the machine operator.

Figure 8:
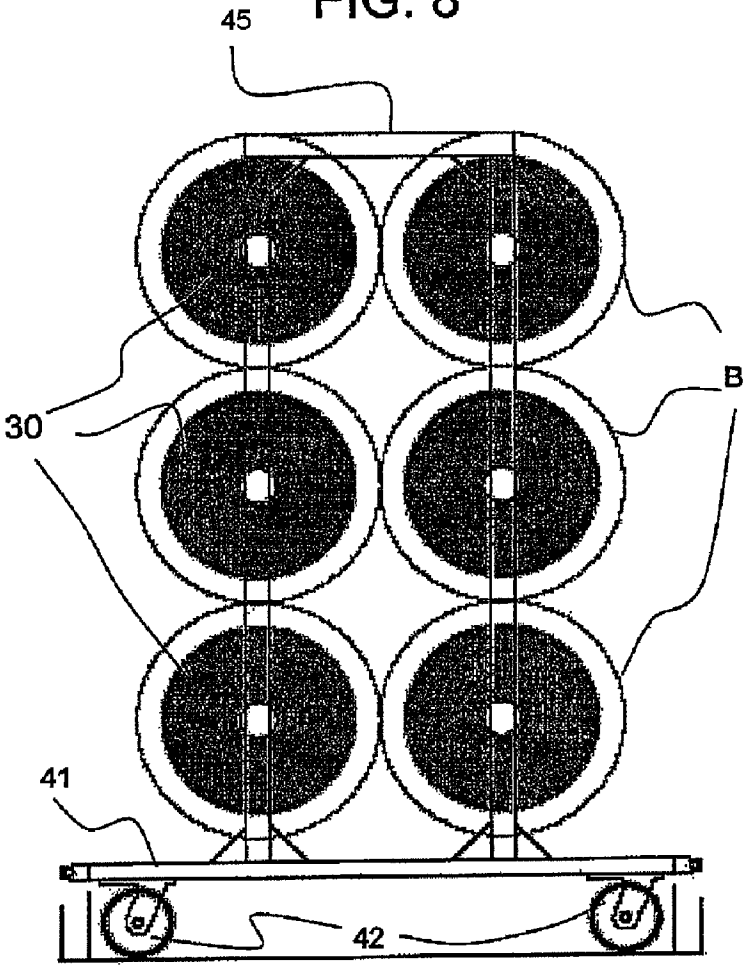
FIG. 8 depicts a side elevational view of a cartridge.
Figure 7:
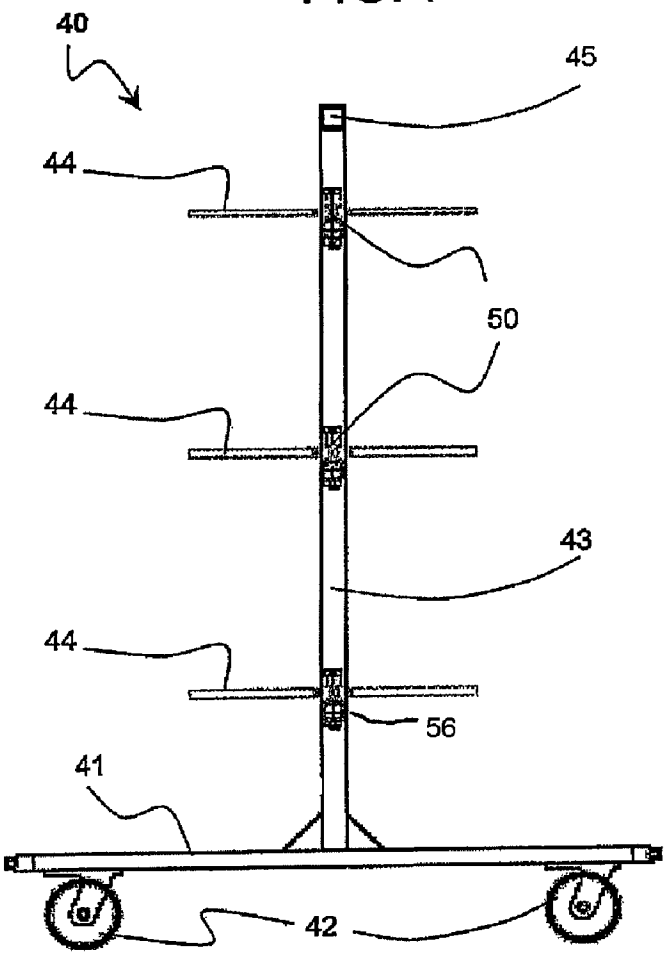
FIG. 7 depicts an end view of a cartridge.

In reference to FIGS. 7-8, replaceable cartridge, or cart 40, is comprised of a platform 41 supported by ground wheels 42 and a post, or vertical frame 43 mounted to and extending from platform 41. In the embodiment depicted, support arms 44 are provided in opposed pairs, pivotally mounted to vertical frame 43 via a package rotator 50. As may be seen, package rotators 50 are attached to vertical frame 43 arranged in a creel like fashion having a predetermined number of columns, rows and banks defining a array which are selected based upon facility requirements or other operational considerations. In this embodiment support arms 44 are arranged in a 2×3×2 array, that is two columns, three rows, and two banks, about vertical frame 43 for a total of twelve packages 30 per cartridge 40. A horizontal frame member 45 may be provided between adjacent vertical frame members 43 for added support.

In the configuration depicted, package rotator 50 permits rotation of support arms 44 through an arc of 180 degrees about a vertical axis corresponding to its respective vertical frame member 43. Package rotator 50 is comprised of support arms 44 attached to and extending laterally outwardly from a collar 51. Collar 51 rotates about a rotator bearing surface 52, which is provided with a guide channel 53. Guide channel 53 receives a guide pin 54 extending from an inner surface of collar 51, to guide and constrain the extent of rotation of support arms 44. Guide channel 53 should also have a detent 55 to ensure positive alignment of support arm 44 and to alert the operator when support aim 44 is rotated to the correct position.

Package rotator 50 may be configured according to the arrangement described in U.S. Provisional Patent Application No. 60/885,743, incorporated herein by reference, with guide channel 53 defined in a substantially horizontal plane. Alternatively, instead of providing a discrete rotator bearing, rotator bearing surface 52 may be provided by an outer surface of the vertical frame members 43, and guide channel 53, may be cut in the vertical frame members 43. Package rotators 50 are positioned at an appropriate elevation on vertical frame 43 based on the diameter of the package 30 and material being utilized in the manufacturing process. A modified set collar 56 may be mounted below each rotator bearing surface 52 to support collar 51 at the bearing surface 52. Collar 51 may then be slid down vertical frame 42 during assembly. In the embodiment depicted, collar 51 has threaded apertures 57 spaced 180 degrees apart. The support arms 44 may then be inserted into the threaded apertures 57 to protrude into the guide channel 53, thus allowing 180 degree movement around the upright 23 and supporting the weight of the package 30. As best seen in reference to FIGS. 4A and 4B, cartridge 40 further comprises a guide system for routing stranded material S to magazine 20 when cartridge 40 has been inserted into magazine 20.

Figure 5:
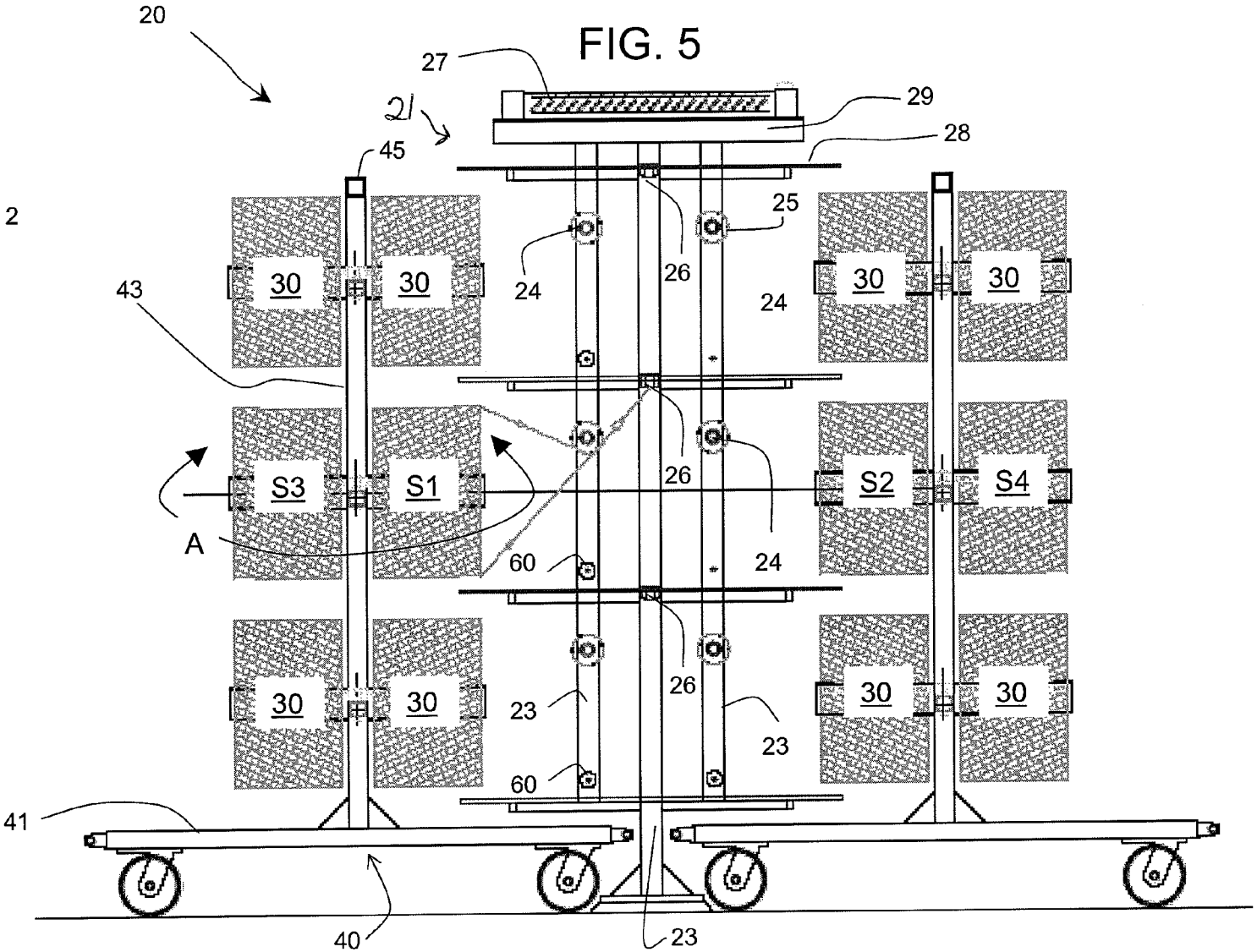
FIG. 5 depicts an end elevational view of a magazine.
Figure 6:
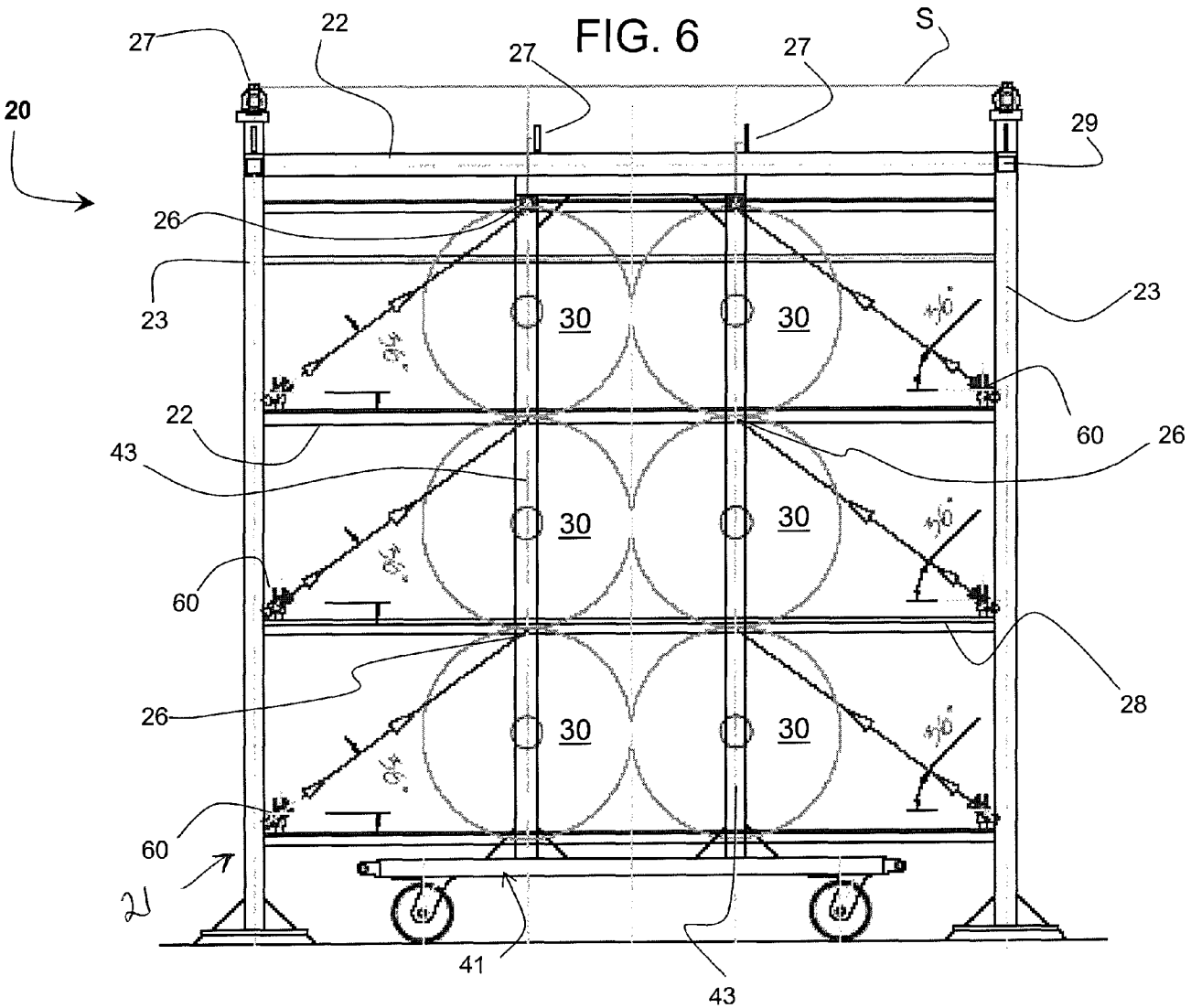
FIG. 6 depicts a side elevational view of a magazine.

Referring to FIGS. 4, 5 and 6, stationary magazine frame 21 is secured to the floor of the manufacturing facility and is fed material supplied from either side of magazine frame 21 by packages 30 carried by cartridge 40. Stationary magazine frame 21 comprises a plurality of longitudinal members 22 interconnecting upright members 23. Upright members 23 are spaced apart by a distance corresponding to the width of cartridge 30. Horizontal members 22 are positioned between upright members 23 at a position slightly above its associated package 30 carried by cartridge 40 and below a subsequent package 30 positioned above the associated package 30. Magazine frame 21 and cartridges 40 should be configured such that cartridges 40 are received within in the frame 21 in proper alignment and are properly secured to prevent unwanted movement during use. Any suitable means are acceptable, for example, carts 40 may be indexed with respect to magazine frame 21, a floor tracks or even cartridge guides, whether incorporated with frame 21 or ancillary to them may also be suitable.

Magazine frame 21, includes a magazine guide system that will accommodate each running end of material S supplied by cartridge 30 and route it to the creel 10. As best seen in reference to FIG. 5, the guide system includes guide rods 24 extending laterally and inwardly from upright members 23 towards the interior of magazine 20. Guide rods 24 are positioned slightly above a longitudinal axis of its associated package 30, and laterally outwardly from a longitudinal centerline of magazine frame 21. As will be recognized by those skilled in the art, particularly with respect to stranded materials such as yarns utilized in textiles, as the yarn is pulled from the package 30, it will unwind from package 30 and form a balloon around and at the end of the package 30. Guide rod 24 is positioned to reduce the diameter of the balloon coming off the package. Preferably, guide rod 24 will be vertically adjustable to maintain a limiting effect on balloon formation as package 30 is depleted. Guide rods 24 may include a roller sleeve 25 to reduce friction between the rod 24 and material S. Primary guides 26 are provided in horizontal members 22 in spaced relation to each other to direct each strand of material from guide rod 24 and route it vertically to the top of magazine 20. Primary guides 26 are preferably ceramic, but may be made of any suitable material. Secondary guides 27, which may include a guide board or roller, are mounted on an upright member 23 proximal to creel 10, and receive material directed laterally from an uppermost set of primary guides 26. Material leaving secondary guides 27 is then directed towards and carried by guides 11, guide boards 12, and/or return roller 13 of creel 10, depending upon the magazine's placement in relation to creel 10.

To reduce the potential for the balloons of adjacent packages becoming entangled, magazine frame 21 may also be provided with a shield 28 mounted to transverse members 29 attached to and extending perpendicular to upright members 23. More preferably, shield 28 is comprised of a transparent material, such as glass or plexiglass, so that the operator may visually inspect the condition of the yarn feeds within magazine 20 and that of the supplying packages 30 and cartridges 40. A transparent shield 28 will also facilitate the operator's ability to join and route successive running ends.

The configuration of the creel magazine supply system thus described permits improved efficiency in the delivery of stranded material to a manufacturing process. First, the transportability of cartridges 40 permits loading of packages 30 by automated methods such as that disclosed in U.S. Provisional Patent Application No. 60/885,743, so that loading of packages 30 onto support arms 44 is performed remotely from the magazine 20, thereby reducing the complexity of tasks performed at the magazines 20. Similarly, because cartridge 40 may be loaded via automated means, the size, and thereby the length of stranded material carried by a package 30 may be dramatically increased, from the 8-14 pounds in conventional manual systems, to at least forty pounds permitted by automated loading systems. Because the strand length is increased, a significant source of breakages, i.e. knots or joints, are substantially reduced, thereby contributing to the efficiency and reliability of the process.

Next, the magazine configured creel eliminates a primary and substantial source of musculo-skeletal injury exposure presented by loading packages 30 at the creel. By providing a mobile, fully loaded cartridge 40, the magazine 20 can be replenished without lifting necessary in conventional methods. As will be more fully described below, the creel magazine 20 of the present invention permits the system to be pre-loaded with at least four packages 30 of material prior to initiating a run. The unique configuration of the magazine 20 and its associated cartridges 40 permits each of four packages 30 to be fed in sequence to the manufacturing process, alternating between packages 30 carried on a first cartridge 40 and second cartridge 40'. As annotated in FIG. 5, packages S1-S4, are fed sequentially to magazine 20, in a modified tip to tail, back and forth fashion, whereas current systems feed tip to tail in a side by side configuration. This magazine configuration and method effectively doubles the initial package 30 capacity of the creel 10 from two packages 30 to four.

To run packages 30 in the modified tip to tail fashion, the leading end of material from package S1 is routed under guide rod 24 and then upwardly through primary guides 26 to the top of magazine 20. From there, the leading end is carried horizontally to secondary guide, or guide board 27 and then integrated with the guides 11, guide boards 12, or return roller 13 of the creel 10 depending upon a magazine's 20 placement in the process configuration. Each of the six corresponding S1 packages are routed in similar manner. By guiding the materials to the top of the magazine frame 21, the operators may have ready access to the magazine 20 and its associated cartridges 40.

Figure 9:
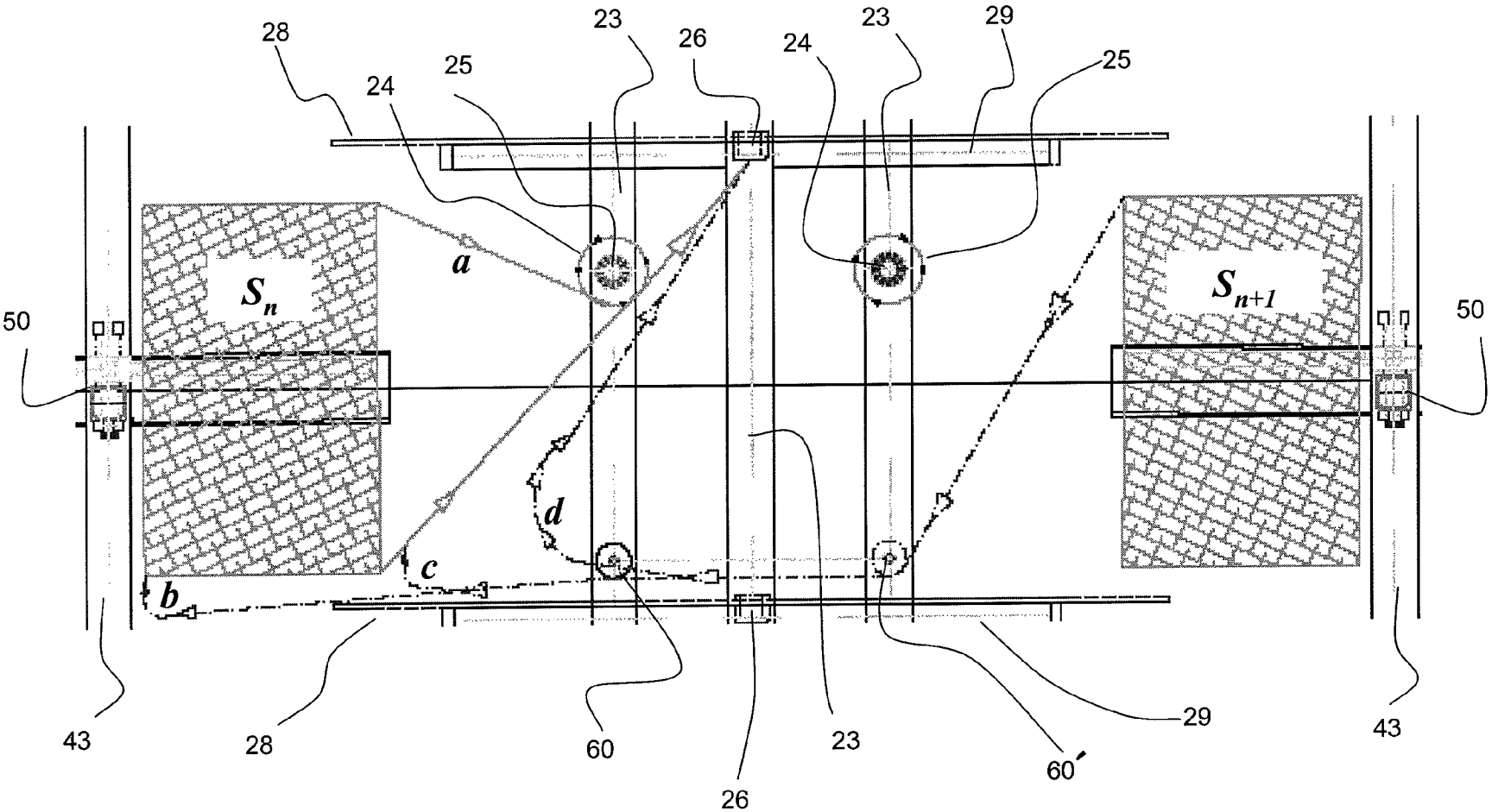
FIG. 9 depicts a detailed end elevational view of the threading of successive packages.
Figure 10A:
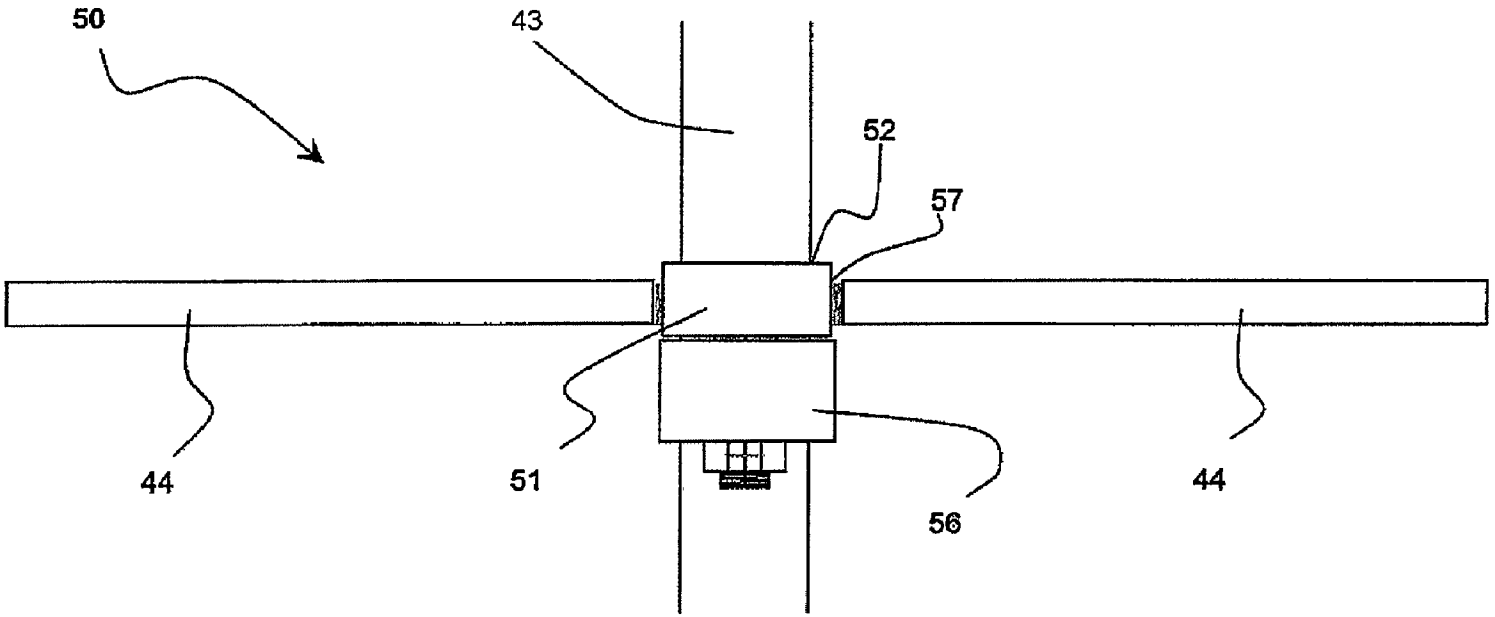
FIG. 10A depicts a side elevational view of a cartridge post and package rotator.
Figure 10B:
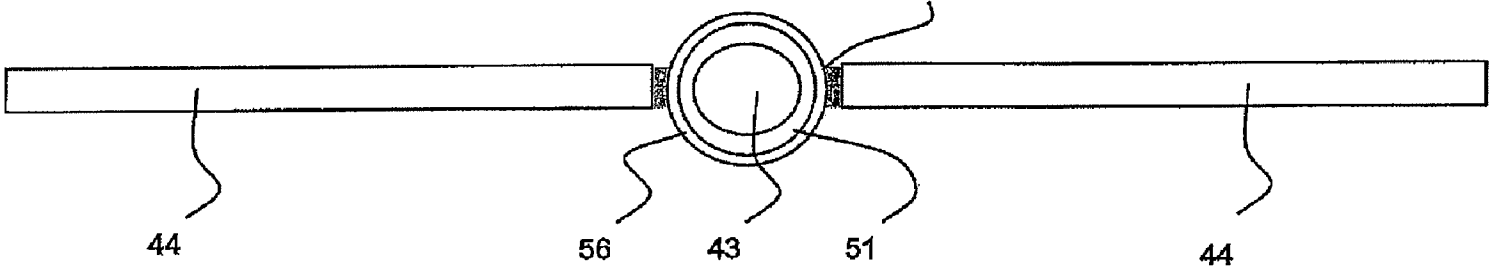
FIG. 10B depicts an overhead plan view of a cartridge post and package rotator.

As may be seen in reference to FIG. 9, the trailing end of package $S_n$ is tied or joined with the leading end of package $S_{n+1}$, which is mounted on cartridge 40' positioned transversely across magazine 20 from cartridge 40. As previously described, as the yarn spools off its package 30 it creates a balloon around the package 30. Therefore, when joining the tip of a subsequent package $S_{n+1}$ to the tail of its preceding package $S_n$, the joined material, primarily the leading end of $S_{n+1}$, must be retained out of the way to prevent the "balloon" on the running package $S_n$ from tangling. In like manner, the running of material from the subsequent package must be allowed pull thru and out of the retaining apparatus once transfer to the subsequent package commences.

Figure 11:
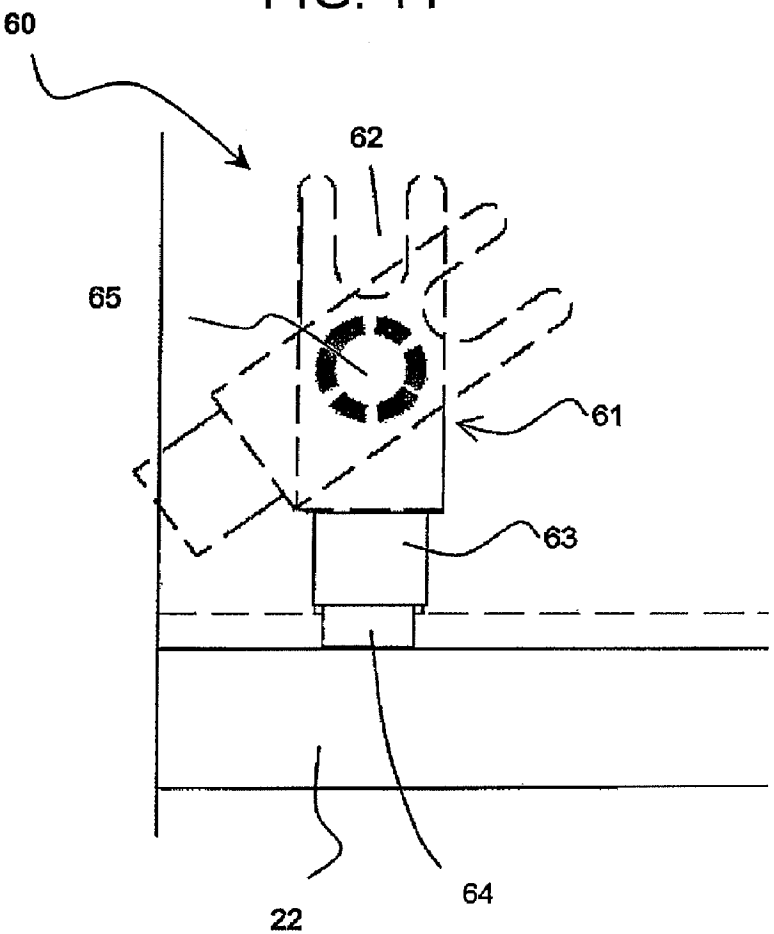
FIG. 11 depicts a side elevational view of a transfer device.
Figure 10C:
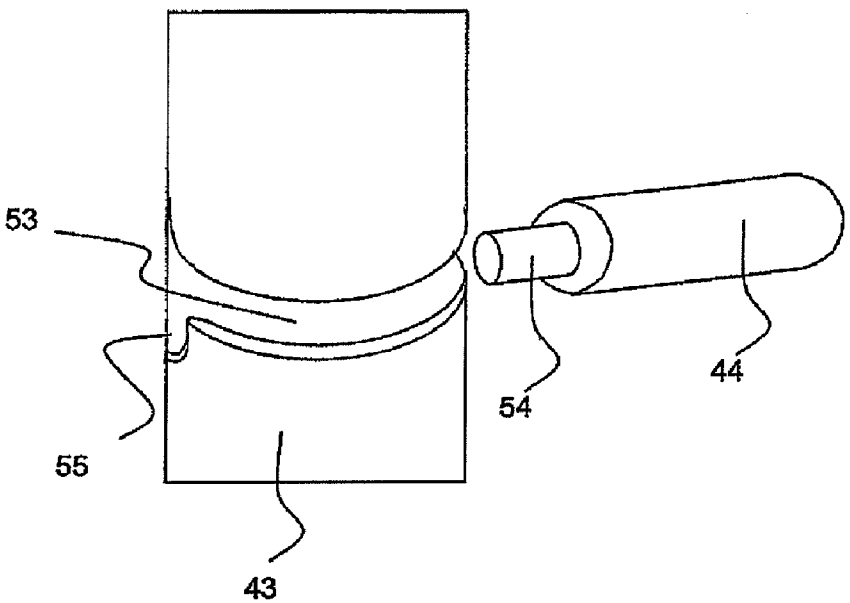
FIG. 10C depicts a perspective view of a guide channel, defined in a cartridge post.

To achieve this, a transfer device 60, such as that depicted in FIG. 11 is provided mounted near the center line of the magazine frame 21 to the outside of each package 30 running position, as may be seen in reference to FIGS. 6 and 9. Transfer device 60 comprises an elongate member, or bar 61, having a U-shaped notch 62 formed at a first end of bar 61 and a counterweight 63 formed at a second end of bar 61. Bar 61 is pivotally mounted to a post 64 via a pivot 65. Counterweight 63 is selected such that notch 62 is oriented vertically in a retaining position and that slight lateral forces will permit bar 61 to pivot and orient notch 62 to a release position.

In reference to FIG. 9, the routing of the running ends is depicted in detail illustrating the initial routing of package $S_n$, the modified tip to tail side by side interconnection of packages $S_n$ and $S_{n+1}$, and the transfer of material supply between $S_n$ and $S_{n+1}$. The initial routing of the running end of package $S_n$ is shown by the arrowed line a, at the top of the left hand package $S_n$. The running end is routed under guide rod 24 and upwardly to primary guide 26. At the lower left hand side, the leading end of yarn $S_{n+1}$ is depicted by dashed arrowed line b, and is shown tied to the tail end of package $S_n$ and is routed through transfer device 60. As the material from package $S_n$ is depleted, the joined ends of material $S_n$ and $S_{n+1}$, are drawn towards guide rod 24 and primary guide 26 as depicted by the joined lines at c, at the lower end and slightly to the right of package $S_n$. As the joined ends are drawn upwardly towards primary guide 26, running end $S_{n+1}$ begins to exert pressure on the side of notch 62 so that transfer device 60 tips laterally to release running end $S_{n+1}$, from notch 62, shown by dashed line d, effectuating transfer of supply from package $S_n$ to package $S_{n+1}$, which will be complete once the running end of $S_{n+1}$ is released from transfer device 60'. Depending upon the diameter of packages 30, an additional transfer device 60 may be required to be positioned on each cart and at the outer ends thereof, so that effective retention and transfer may be effectuated. Upon complete transfer, running end $S_{n+1}$ will be pulled upwardly until engaging guide rod 24' and routing will proceed according to the initial condition for package $S_{n+1}$. After transfer to package $S_{n+1}$ is complete the depleted package $S_n$ is rotated about axis A as depicted in FIG. 5 and fresh package 30 is positioned within magazine frame 21. In repeating the sequence, the previously defined package $S_{+1}$ becomes $S_n$ and the rotated replenished package 30 becomes the next $S_{n+1}$. According to this method, a fully loaded creel magazine 20 can provide an initial run twice that of conventional creels before the magazine 20 will require replenishment, thereby leading to greater efficiency in the process. As will be readily appreciated, once a cartridge 40 is depleted, it may be removed from the magazine 20 and replaced with a replenished cartridge 40, and the process continued.

Thus, one of the may objectives of the present invention is to allow the cartridges 40 to be loaded at a remote location so as to eliminate loading tasks at the magazine 20. Additional efficiency may be realized where a material undergoes a prior process to be produced as a package 30 at the conclusion of that process. Customarily, packages 30 produced in a previous process are simply loaded and stacked in a bulk carrying cart and then wheeled to the next process station at which the packages 30 are then manually removed from the bulk carrying cart and loaded into the next process. By the method contemplated by the present invention, the packages 30 may be directly loaded onto a cartridge 40 upon completion of the previous process, thereby saving labor costs and increasing efficiency by eliminating double handling the packages 30.

While this invention has been described with reference to preferred embodiments thereof, it is to be understood that variations and modifications can be affected within the spirit and scope of the invention as described herein and as described in the appended claims.

I claim:

1. A creel magazine for supplying stranded materials to a manufacturing process comprising: a stationary magazine frame and a pair of replaceable cartridges positioned on opposite sides of said magazine frame, each replaceable cartridge comprising a plurality of ground wheels, a generally horizontal platform, a vertical frame, and a plurality of package holders, said plurality of ground wheels supporting said generally horizontal platform, said platform supporting said vertical frame attached to said platform, and said plurality of package rotators pivotally attached to and rotatable about said vertical frame, each said rotator of said plurality of rotators having at least two support arms extending outwardly from said rotator and disposed at a angle relative to one another, said at least two support arms adapted to receive and support a spooled package of stranded material, said package rotators disposed in a predetermined spaced relation relative to said magazine frame; said magazine frame comprising a plurality of upright members, a plurality of horizontal members extending between said upright members at intervals corresponding to the number and size of said packages carried by said cartridge, a plurality of primary guides disposed in spaced relation on said horizontal members, and at least one secondary guide disposed on a lateral end of said magazine frame further including a trailing end of said package on said first side is connected to a leading end of said package on said opposite side, said primary guides and said secondary guides disposed for receiving and carrying a discrete running length of said stranded material fed sequentially from a package carried by a cartridge on a first side of said magazine frame and a corresponding package carried by a cartridge on said opposite side of said magazine frame to said manufacturing process, further comprising a transfer device attached to said magazine frame, said transfer device receiving a length of stranded material between a package carried by a cartridge on a first side of said magazine frame and a corresponding package carried by a cartridge on said opposite side of said magazine frame.

2. The creel magazine of claim 1, wherein said primary guides are disposed to carry a running length of said stranded material vertically within said magazine creel to a top of said stationary magazine frame.

3. The creel magazine of claim 2, wherein said secondary guide is disposed to receive said stranded material laterally from said primary guides located at a top of said stationary magazine frame.

4. The creel magazine of claim 1, wherein said stationary magazine frame further comprises a plurality of guide rods extending generally horizontally and inwardly from said upright members, said plurality of guide rods extending slightly above a longitudinal axis of said package, and interposed between said package and said primary guides.

5. The creel magazine of claim 1, wherein said at least two support arms extend from opposite sides of said rotator.

6. The creel magazine of claim 1, wherein said at least two support arms are rotatable about 180 degrees.

7. A creel magazine for supplying stranded materials to a manufacturing process comprising: a stationary magazine frame, a first movable cartridge and a second movable cartridge positioned on opposite sides respectively of said magazine frame, each said movable cartridge comprising a frame and an array of support arms, said frame carrying said array of support arms attached to said frame, wherein each support arm positions a stranded material package mounted on each support arm in a feed position relative said magazine, and a running length of each stranded material is sequentially routed in a plurality of primary guides mounted to said magazine frame wherein a trailing end of stranded material carried by a first package in said first movable cartridge is connected to a leading end of said stranded material carried by a second package in said second movable cartridge, opposite said first package.

8. The creel magazine of claim 7, further comprising a transfer device attached to said magazine frame, wherein said transfer device releasably receives said connected stranded material.

9. The creel magazine of claim 8 wherein said transfer device releases said connected stranded material as said running length of said stranded material is transferred across said stationary magazine frame.

10. A method of supplying stranded material to a manufacturing process comprising the steps of:

a. providing a plurality of spooled packages holding said stranded material;

b. providing a plurality of movable cartridges for supporting said packages in a predetermined spaced relation on said cartridge;

c. loading said packages on said plurality of movable cartridges in said predetermined spaced relation;

d. positioning a first cartridge of said plurality of movable cartridges at a first side of a magazine frame, wherein said magazine frame is adapted to receive and carry discrete running lengths of said stranded material to said manufacturing process;

e. positioning a second cartridge of said plurality of movable cartridges at a second side of said magazine frame which is opposite said first side relative to said magazine frame;

f. connecting a trailing end of stranded material from a first package at said first side carried by said first cartridge with a leading end of stranded material from a corresponding second package at said second side carried by said second cartridge;

g. repeating step f for each pair of corresponding first and second packages carried by said first cartridge and said second cartridge;

h. feeding said first packages of stranded material through said magazine frame to said manufacturing process;

i. transferring said feeding to said second package upon depletion of said first package without interrupting said manufacturing process.

11. The method of claim 10 further comprising the steps of rotating a third package carried by said first cartridge to occupy the position of said first package and connecting a trailing end of said second package to a leading end of said third package.

12. The method of claim 11 further comprising the steps of transferring said feeding to said third package upon depletion of said second package without interrupting said manufacturing process.

13. The method of claim 12 further comprising the steps of rotating a fourth package carried by said second cartridge to occupy the position of said second package and connecting a trailing end of said third package to a leading end of said fourth package.

14. The method of claim 13 further comprising the steps of transferring said feeding to said fourth package upon depletion of said third package without interrupting said manufacturing process.

15. The method of claim 14 further comprising the step of replacing said first cartridge with a replenished cartridge.

16. The method of claim 15 further comprising the step of connecting a trailing end of said fourth package with a leading end of a first package carried by said replenished cartridge.

17. A method of supplying stranded material to a manufacturing process comprising the steps of:

a. providing a first movable cartridge carrying a first array of packages holding said stranded material;

b. providing a second movable cartridge carrying a second array of packages holding said stranded material;

c. positioning said first movable cartridge at a first side of a magazine frame which is opposite said first side relative to said magazine frame;

d. positioning said second cartridge at a second side of said magazine frame;

e. delivering said stranded material through said magazine frame to said manufacturing process from a first bank of packages carried in said first array that are adjacent to said magazine frame; and f. transferring delivery of said stranded material to a first bank of packages carried in said second array at said second side upon depletion of said packages carried in said first bank of said first array.

18. The method of claim 17 further comprising the step of rotating a depleted package in said first bank to position a second bank package adjacent to said magazine frame.

19. A method of supplying stranded material to a manufacturing process comprising the steps of:

a. supplying a running length of said stranded material to said manufacturing process through a guide supported by a stationary magazine frame, said running length initially supplied from a first package of stranded material carried by a first removable cartridge positioned on one side of said stationary magazine frame;

b. connecting a leading end of a second package of stranded material carried by a second movable cartridge positioned on an opposite side relative to said stationary magazine frame with a trailing end of said stranded material carried by said first package; and c. transferring delivery of said running length of stranded material across said stationary magazine frame to said second package upon depletion of said first package without interrupting supply of said stranded material to said manufacturing process.

20. The method of claim 19 further comprising replacing said depleted first package with a replenished package of stranded material.

21. The method of claim 19 further comprising connecting a leading end of said replenished first package with a trailing end of said second package.

22. The method of claim 21 further comprising transferring delivery of said running length of stranded material across said stationary magazine frame to said replenished first package upon depletion of said second package.

23. The method of claim 22 further comprising replacing said depleted second package with a replenished second package.

24. The method of claim 13 further comprising connecting a leading end of said replenished second package with a trailing end of said replenished first package.

25. The method of claim 24 further comprising transferring delivery of said running length of stranded material across said stationary magazine frame to said replenished second package upon depletion of said replenished first package.

26. The method of claim 19 wherein said first removable cartridge supports a plurality of packages positioned adjacent one another and interconnected in series.

27. The method of claim 19 wherein said second removable cartridge supports a plurality of packages positioned adjacent one another and interconnected in series.

* * * * *